US007350450B1

(12) United States Patent
Chu et al.

(10) Patent No.: US 7,350,450 B1
(45) Date of Patent: Apr. 1, 2008

(54) ARMOR STRUCTURES

(75) Inventors: Henry Shiu-Hung Chu, Idaho Falls, ID (US); Jeffrey M. Lacy, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 67 days.

(21) Appl. No.: 11/532,728

(22) Filed: Sep. 18, 2006

(51) Int. Cl.
*F41H 5/02* (2006.01)
*F41H 5/00* (2006.01)
*F41H 5/24* (2006.01)

(52) U.S. Cl. ..... 89/36.02; 89/36.01; 89/36.04

(58) Field of Classification Search ..... 89/36.02, 89/36.04, 36.01
See application file for complete search history.

(56) References Cited

U.S. PATENT DOCUMENTS 2,212,481 A * 8/1940 Sendzimir ..... 228/118
3,616,115 A * 10/1971 Klimmek ..... 109/84
4,133,158 A * 1/1979 Ting ..... 52/478
4,846,923 A * 7/1989 Lines ..... 156/353
5,601,258 A * 2/1997 McClymonds ..... 244/171.7
5,686,689 A * 11/1997 Snedeker et al. ..... 89/36.02
6,418,832 B1 * 7/2002 Colvin ..... 89/36.02
6,523,450 B1 * 2/2003 Schreiber ..... 89/36.11
6,526,861 B1 * 3/2003 Gruber ..... 89/36.04
6,622,607 B1 * 9/2003 Miller ..... 89/36.07
6,973,864 B1 * 12/2005 Ahmad ..... 89/36.02
7,037,865 B1 * 5/2006 Kimberly ..... 442/181
2002/0164447 A1 * 11/2002 Asgian ..... 428/40.1
2004/0049995 A1 * 3/2004 Rogers ..... 52/177
2005/0022658 A1 * 2/2005 Bateman et al. ..... 89/36.01
2005/0074593 A1 * 4/2005 Day et al. ..... 428/292.1
2006/0141232 A1 * 6/2006 Ma ..... 428/292.1
2006/0269738 A1 * 11/2006 Kimberly ..... 428/323
2007/0015000 A1 * 1/2007 Burdon ..... 428/593
2007/0166514 A1 * 7/2007 Friedman et al. ..... 428/156

FOREIGN PATENT DOCUMENTS

JP 58017019 A * 2/1983

* cited by examiner

*Primary Examiner*—Victor Batson
*Assistant Examiner*—Michael D David
(74) *Attorney, Agent, or Firm*—Wells St. John

(57) ABSTRACT

An armor structure includes first and second layers individually containing a plurality of i-beams. Individual i-beams have a pair of longitudinal flanges interconnected by a longitudinal crosspiece and defining opposing longitudinal channels between the pair of flanges. The i-beams within individual of the first and second layers run parallel. The laterally outermost faces of the flanges of adjacent i-beams face one another. One of the longitudinal channels in each of the first and second layers faces one of the longitudinal channels in the other of the first and second layers. The channels of the first layer run parallel with the channels of the second layer. The flanges of the first and second layers overlap with the crosspieces of the other of the first and second layers, and portions of said flanges are received within the facing channels of the i-beams of the other of the first and second layers.

47 Claims, 4 Drawing Sheets

ARMOR STRUCTURES

GOVERNMENT RIGHTS

This invention was made with Government support under Contract DE-AC07-05ID14517 awarded by the U.S. Department of Energy. The Government has certain rights in the invention.

TECHNICAL FIELD

This invention relates to armor structures.

BACKGROUND OF THE INVENTION

Armor structure is used to preclude an adversary from crossing a line and/or preventing access to a facility such as a building, or to a room within a building. An exemplary armor structure might be in the form of a load-bearing wall, an exterior door to a building, and/or an interior door to a room within a building. The invention herein was primarily motivated in creating armor structure in the form of an exterior door for providing access, and precluding undesired entry, to a building. However, the invention in its broadest aspects is in no way so limited.

Armor structures might be designed for resisting an attack from a number of possible breaching sources, for example a large-caliber breaching weapon (i.e., a platter charge or a flyer plate), as well as from a variety of other possible attacks such as mechanical and abrasive cutters, plasma torches, oxygen lances, line-shaped explosively-formed charges, and free-air blasts. A flyer plate attack is very severe, typically employing a large-caliber breaching weapon composed of a circular plate of mild steel driven and formed by hundreds of pounds of C4 explosive. It is intended to punch a human-sized hole through a door or wall in a single strike, and is primarily a challenge to the core of the door or wall armor structure. Incidental loads are also provided to the rest of the door or wall from free-air blast attack from the firing of the flyer plate. A free-air blast, in the absence of a flyer plate, typically consists of a sphere of C4 explosive detonated towards a wall or door. Of course, it is likely that other and greater severity attacks will be developed in the future.

Preferred designs for an armor structure, whether a wall, door or other construction, ideally will absorb and disperse incident energy, perhaps using controlled and progressive deformations of the armor structure to increase the event duration and decrease peak loads transmitted to adjacent portions of a structure. The deformations may render a door or other armor structure inoperable after an attack, which is likely still acceptable if entry by an adversary is ultimately prevented.

While the invention was motivated in addressing the above identified issues, it is in no way so limited. The invention is only limited by the accompanying claims as literally worded, without interpretative or other limiting reference to the specification, and in accordance with the doctrine of equivalents.

SUMMARY

The invention encompasses armor structures. In one implementation, an armor structure includes first and second layers individually comprising a plurality of i-beams. Individual i-beams comprise a pair of longitudinal flanges interconnected by a longitudinal crosspiece and defining opposing longitudinal channels between the pair of flanges. The flanges have laterally outermost faces. The plurality of i-beams within individual of the first and second layers run parallel relative to one another with the laterally outermost faces of the flanges of adjacent i-beams facing one another. One of the longitudinal channels in each of the first and second layers faces one of the longitudinal channels in the other of the first and second layers. The i-beam channels of the first layer run parallel with the i-beam channels of the second layer. The flanges of the i-beams of the first and second layers overlap with the crosspieces of the other of the first and second layers, and portions of said flanges are received within the facing channels of the i-beams of the other of the first and second layers.

Other aspects and implementations are contemplated.

BRIEF DESCRIPTION OF THE DRAWINGS

Preferred embodiments are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
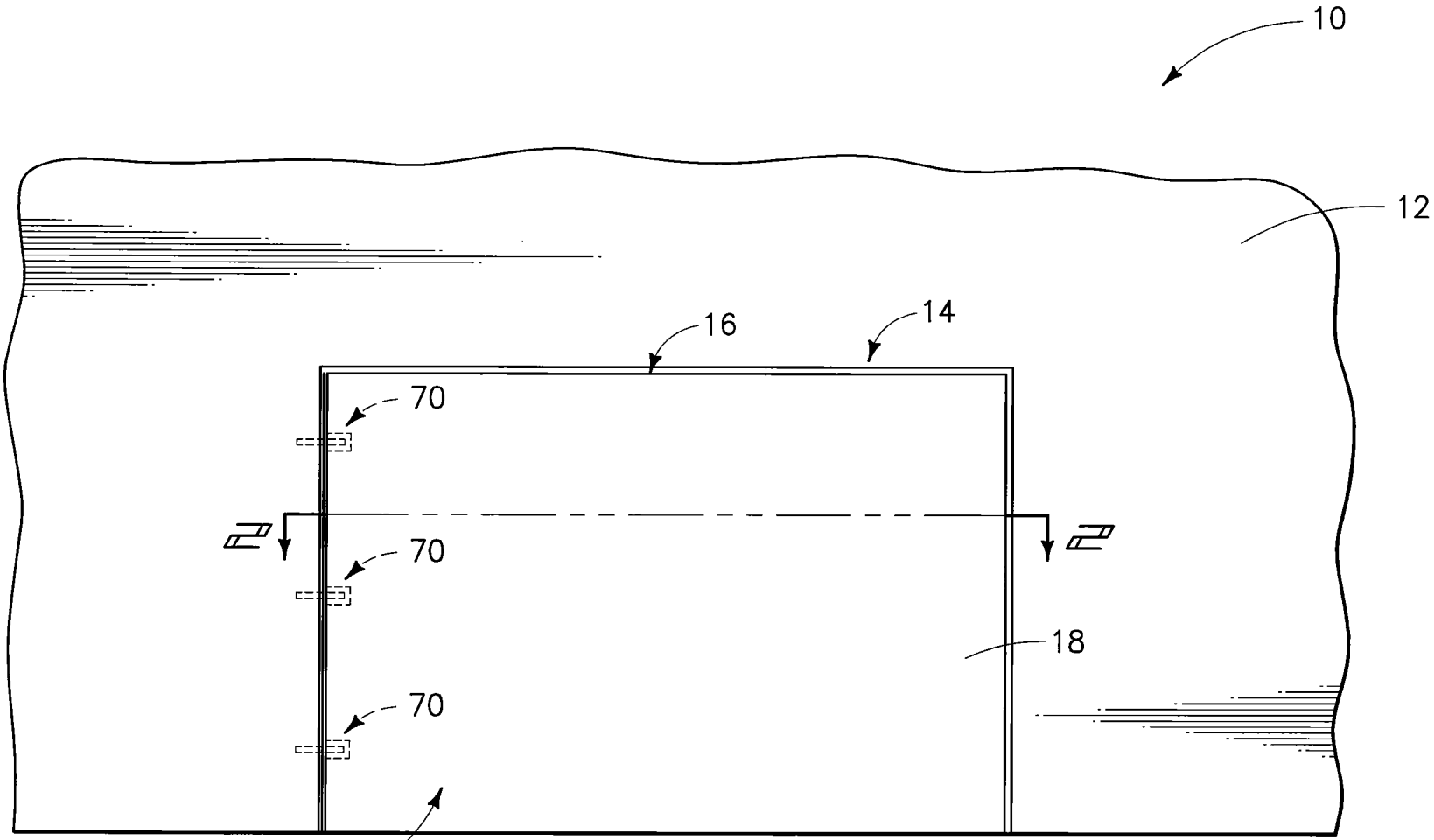
FIG. 1 is a diagrammatic elevational view of a building wall incorporating an armor structure in accordance with an exemplary aspect of the invention.

Exemplary preferred embodiment armor structures are described, by way of example only, with respect to FIGS. 1-5. FIG. 1 depicts a building or barrier 10 comprising a wall 12. A doorway 14 is provided in wall 12 and includes a securable door 16 that can be opened and closed relative to doorway 14, for example mounted for swinging movement relative to hinges (not shown) on an interior or exterior side of wall 12. In the exemplary described embodiment, securable door 12 will constitute or comprise one embodiment of an armor structure in accordance with exemplary aspects of the invention. Of course, wall 12 might also be configured in accordance with inventive aspects of an armor structure as disclosed and claimed herein, and of course other armor structures in accordance with aspects of the invention might be created independent of association with a building or other structural enclosure. For purposes of the continuing discussion, armor structure 16 in certain implementations can be considered as having a primary attack side 15 from which the greatest breaching threat is anticipated.

Referring to FIGS. 1-4, armor structure or door 16 is depicted as comprising a plurality of layers or panels received within a peripheral frame or framework 17. Peripheral framework 17 preferably comprises a suitable steel (i.e., A36 steel). An example maximum lateral thickness for frame 17 is anywhere from 3" to 4". An exemplary reduction-to-practice door assembly had a total depth $D_t$ of 15".

Dimensions might, of course, vary depending upon the degree of threat for which the armor structure is designed. That which is described herein was designed for being able to stop, without breaching, a 20" platter charge, for example as described in the Background section above. A reduction-to-practice and tested armor structure 16 had a height and width of 76" and 84", respectively.

Armor structure 16 includes numerous layers or panels which, in the preferred embodiment, are depicted as retained by framework 17. Regardless of framework 17, an armor structure in accordance with the invention might include more or fewer layers than those depicted herein, with the invention only being limited by the accompanying claims as literally worded and interpreted in accordance with the doctrine of equivalents. An armor structure in accordance with an aspect of the invention is expected to, as a minimum, include first and second layers which individually comprise a plurality of i-beams, for example as described in greater detail below.

Preferred embodiment armor structure 16 is depicted as comprising a suitable covering, for example a ½" thick mild steel (i.e., A36 steel) cover sheet or layer 18. An obscurant-generating layer 20 is received behind cover layer 18. Obscurant-generating layer 20 is configured to generate an obscurant upon a sufficient degree of heat to armor structure 16. By way of example only, such might comprise a polycarbonate sheet from ½" to 1" thick. Such a material, upon suitable applied heat for example from a high-temperature cutting torch, will generate significant black smoke which might hinder intruders, and perhaps as well suppress fire or the burning of other components of armor structure 16.

Armor structure 16 includes a first layer 22 and a second layer 24 individually comprising a plurality of i-beams 26. In one preferred implementation, i-beams within individual of first layer 22 and second layer 24 are of the same cross-sectional size and shape, and in an even more preferred embodiment all i-beams 26 within both of first and second layers 22 and 24 are of the same cross-sectional size and shape. The invention was reduced-to-practice utilizing exemplary commercial-grade S3-5×7 i-beams 26 made of A36 grade steel.

Figure 4:
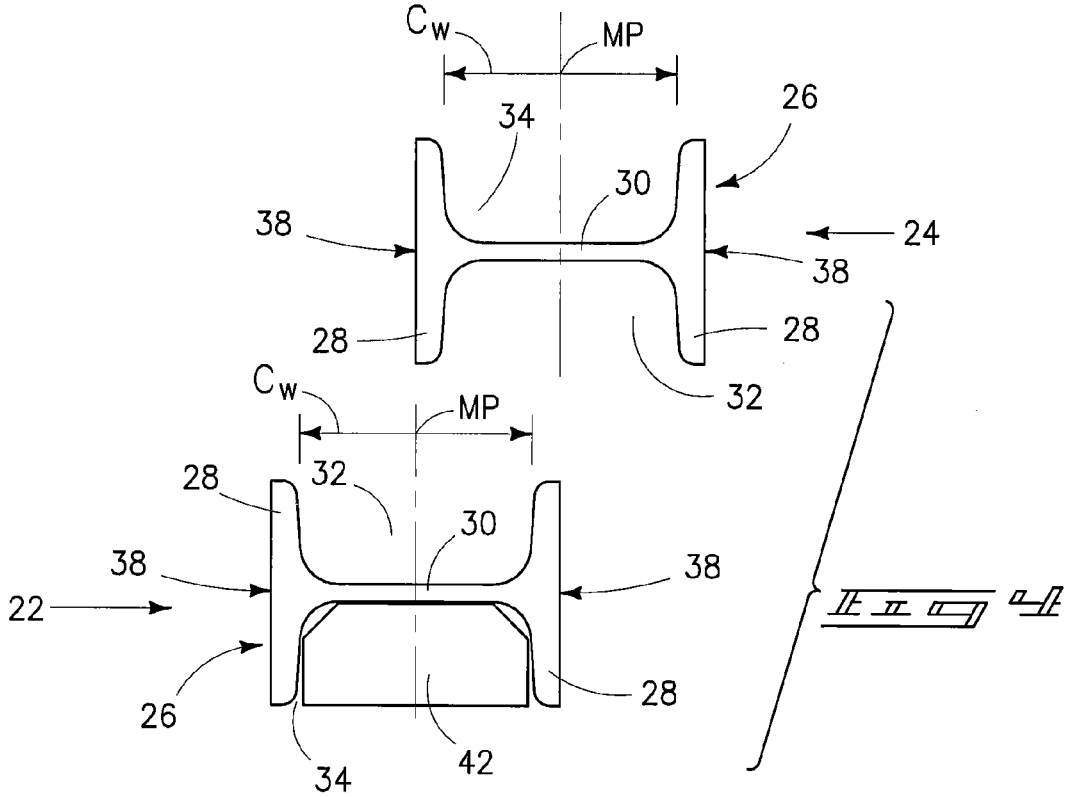
FIG. 4 is an enlarged diagrammatic exploded view of a portion of certain wall layers of the structure of FIG. 2, showing two i-beams.

For purposes of the continuing discussion and for ease of description, FIG. 4 depicts an exploded view of a portion of first layer 22 and second layer 24 with respect to a single i-beam 26 in each such layer. Individual i-beams 26 can be considered as comprising a pair of longitudinal flanges 28 interconnected by a longitudinal cross-piece 30, and which defines opposing longitudinal channels 32 and 34 between the pair of flanges 28. Flanges 28 can be considered as having laterally outermost faces 38. The plurality of i-beams 26 within individual of first layer 22 and second layer 24 run parallel relative to one another, with laterally outermost faces 38 of adjacent i-beams 26 facing one another, and most preferably as shown in the depicted embodiment, also contacting one another. For example and by way of example only, such might be merely abutting one another or alternately adhered relative to one another, for example by continuous or spot welding or by other interconnection. FIG. 4 depicts longitudinal channels 32 in each of first and second layer 22 and 24, respectively, as facing one another, with non-facing channels 34 facing away from one another.

I-beam channels 32, 34 of first layer 22 run parallel with i-beam channels 32, 34 of second layer 24. Flanges 28 of i-beams 26 of first and second layers 22, 24 overlap with cross-pieces 30 of the other of the first and second layers 22, 24, and portions of such flanges 28 are received within the facing channels 32 of i-beams 36 of the other of the first and second layers 22, 24. Accordingly, an overlapping and nesting-like relationship is ideally achieved.

Preferably, such overlap is ideally proximate or at a mid-point with respect to the individual cross-pieces. For example, FIG. 4 depicts an exemplary cross-piece width $C_w$ between flanges 28 of individual i-beams 26. Such can be considered as having a cross-piece lateral mid-point MP between flanges 28. In one preferred implementation, the overlapping of flanges 28 of i-beams 26 of the first and second layers 22, 24 is centered within 25% of the mid-point MP as a function of the dimension of cross-piece width $C_w$ between flanges 28 of individual i-beams 26. For example and by way of example only, if $C_w$ is equal to 6", preferably the overlapping of the flanges is centered within 1.5" of mid-point MP to be centered within 25% of such mid-point. However even more preferably, the overlapping is centered within 10% of such mid-point, and even more preferably centered within 1% of such mid-point, and most preferably directly at such mid-point as is depicted in the disclosed embodiment. Such is believed to result in achieving the greatest barrier resistance or strength for the armor structure.

Further and regardless, and as shown, the portions of the flanges 28 of i-beams 26 of first and second layers 22, 24 which are within facing channels 32 of the other of the first and second layers 22, 24 preferably contact cross-pieces 30 of the other of the first and second layers 22, 24. Accordingly in one preferred embodiment, a nested, overlapping, relationship is achieved where the flanges are both substantially centered relative to the adjacent layer and contacting each associated opposing cross-piece.

In one preferred embodiment, volcanic glass is received within at least one of non-facing channels 34 of i-beams 26 of first and second layers 22, 24. Volcanic glass is preferably utilized as a blast absorber that gets crushed and absorbs shock upon effective impact, and also might provide a superior insulating shield against high-temperature attack, for example by a thermal cutting apparatus. In the depicted exemplary embodiment, volcanic glass 42 is received within the non-facing channel 34 which faces primary attack side 15 of the first and second layer which is closest to primary attack side 15, which is first layer 22 in the depicted example. The volcanic glass might be received in channel 34 of second layer 24 (not shown), and perhaps within portions of facing channels 32 (not shown). Exemplary preferred volcanic glass materials include pumice and/or perlite.

Most preferably, the volcanic glass is received within some polymeric carrier or encapsulant, for example polyurethane. For example and by way of example only, pumice strands of an average diameter of from 7 millimeters to 10 millimeters can be used with polyurethane and/or some other encapsulant. Further, an exemplary method of manufacturing the same would be to mix liquid polyurethane and solid volcanic glass together. Such could be cast into the channels of the configuration i-beam desired to be utilized in first layer 22 of an armor structure 16. Such could be allowed to solidify, and then be removed from the i-beam for later insertion or assembly with a first layer 22 of i-beams 26 of the armor structure construction. By way of example only, alternate examples to polyurethane include any two-part epoxy, and polycarbonates. Most preferably, the volcanic glass fills a majority of the non-facing channel 34, and more preferably fills at least 90% of such non-facing channel.

Figure 2:
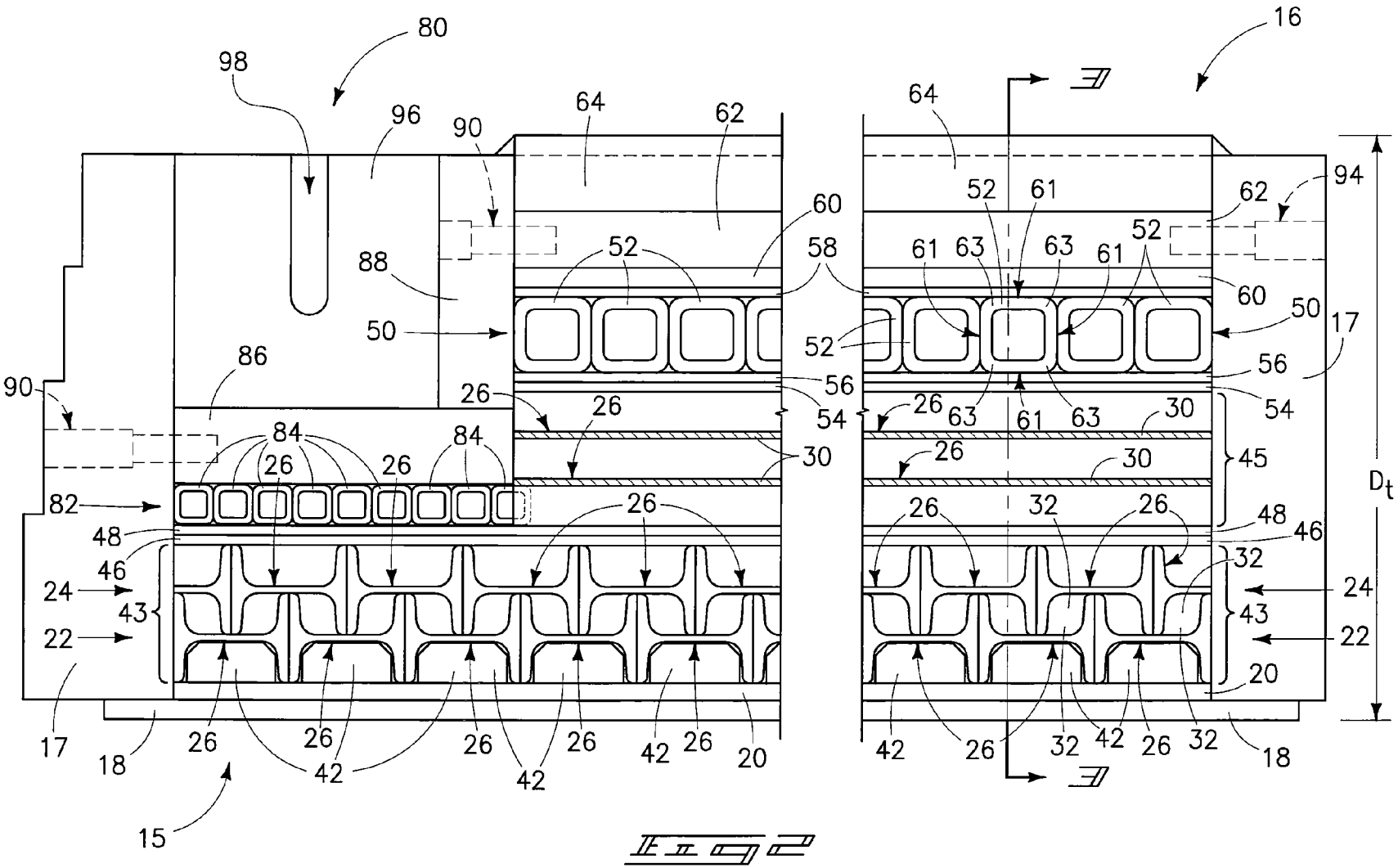
FIG. 2 is an enlarged fragmentary diagrammatic sectional view taken through line 2-2 in FIG. 1.
Figure 3:
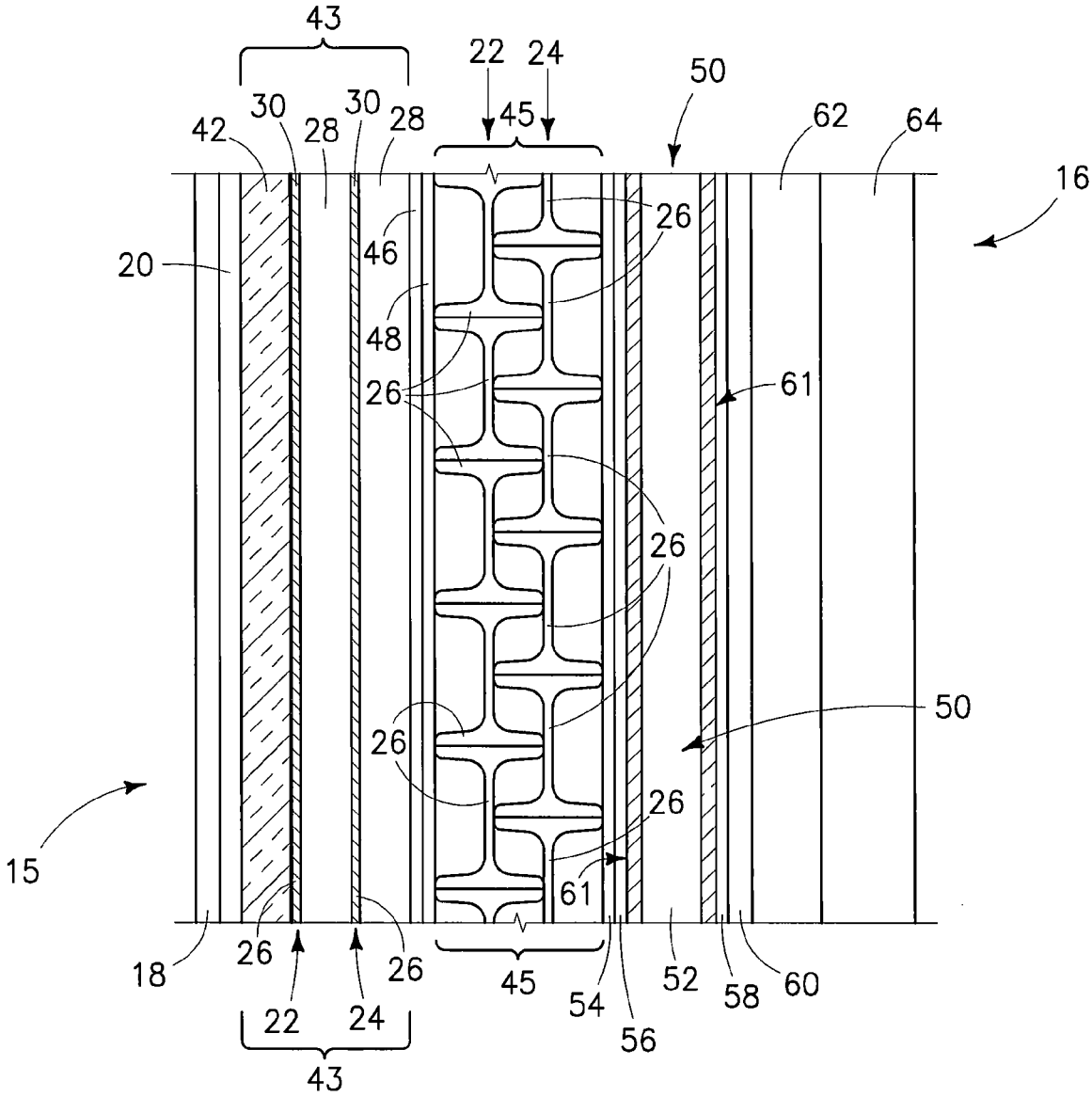
FIG. 3 is a diagrammatic sectional view taken through line 3-3 in FIG. 2.

First and second layers 22, 24 of i-beams 26 can be considered as a first pair 43. Multiple pairs of first and second layers of i-beams might be encompassed by armor structure 16, with two such pairs 43 and 45 being shown. Such might be identical in construction, or different. Regardless if more than one pair, most preferably the channels of first pair 43 are oriented at an angle relative to the channels of second pair 45, with such most preferably being orthogonal within 1° (i.e., where the angle is 90°+/−1°). Further preferably where more than one pair of i-beam layers are utilized, at least one metal layer is received intermediate first pair 43 and second pair 45. FIGS. 2 and 3 show two such layers 46 and 48. Further most preferably, at least some intermediate metal layer received between first pair 43 and second pair 45 is of greater hardness than the hardness of all metal of i-beams 26 of the respective first layers 22 and second layers 24 of first and second pairs 43, 45. For example and by way of example only, where the i-beam steel is A36 grade, an exemplary steel for an intermediate metal layer is that which meets specification mil-S-46100. Reduction-to-practice metal layers 46 and 48 each included ¼" thick mil-S-46100 steel. Of course, additional layers of i-beams 26 might be utilized whether in pairs and regardless of the exemplary depicted nesting.

A layer 50 comprising a plurality of elongated hollow tubes 52 oriented parallel to one another is also provided in the preferred embodiment, preferably behind the plurality of i-beams relative to primary attack side 15. In the depicted embodiment, another two layers 54 and 56 are provided intermediate second pair 45 of first and second layers of i-beams 26 and hollow tube layer 50. Exemplary preferred materials and dimensions for layers 54 and 56 are the same as those described above for layers 46, 48. Hollow tubes 52 might be of any suitable cross-section, with a substantially square cross-section being depicted. Regardless in one particular implementation, hollow tubes 52 are depicted as comprising four planar exterior faces 61, and in one preferred implementation as comprising substantially right angle corners 63. An exemplary reduction-to-practice hollow tube layer 50 comprised a plurality of commercial-grade 2"×2"×¼" thick steel tubes 52.

In one implementation, at least two metal layers are received farther from primary attack side 15 than is layer 50. In one preferred implementation and as depicted, armor structure 16 comprises four metal layers 58, 60, 62 and 64. In one implementation, one of the at least two metal layers comprises a metal that is softer than the metal of each of the metal i-beams 26, the elongated hollow metal tubes 50, and another of the at least two metal layers. In one example, layer 58 comprises another layer of high-hardness armor steel, for example of the same material and dimensions as that of preferred layers 46, 48, 54 and 56. In the depicted exemplary embodiment, layer 60 is an exemplary preferred metal that is softer than any of layers 58, 62 and 64, with aluminum (i.e., 1100-0 aluminum) being an example. An exemplary thickness for layer 60 is 0.5". Exemplary layers 62 and 64 might be A36 steel, with exemplary thicknesses of layers 62 and 64 in a reduction-to-practice example being 1.5" and 2", respectively.

Figure 5:
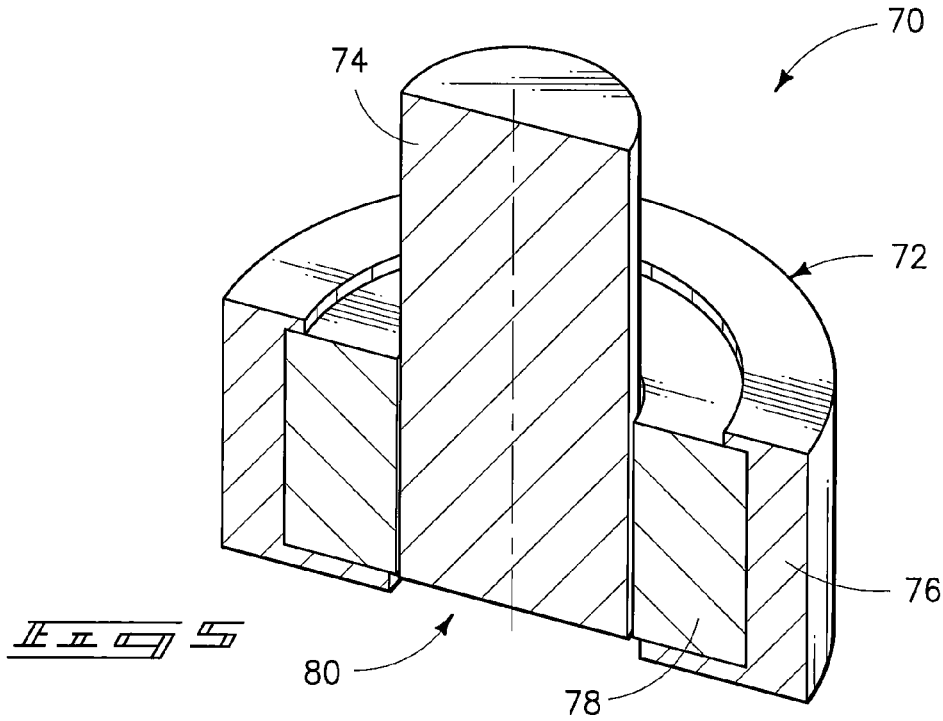
FIG. 5 is a diagrammatic partial sectional view of a door-pin locking mechanism usable with the armor structure of FIGS. 1-4.

In one preferred implementation where armor structure 16 is configured to comprise a securable door that can be opened and closed relative to a doorway, one preferred configuration for such securing is with a plurality of metal locking pin and pin receiver pairs 70 (FIGS. 1 and 5). FIG. 1 depicts an exemplary three such pairs 70. In one preferred implementation, pair 70 includes a pin receiver 72 configured for receiving a metal pin 74 (FIG. 5). In the depicted exemplary embodiment, pin receivers 72 are received by armor structure 16 and metal locking pins 74 are mounted for movement relative to wall structure 12. Such relationship could, of course, be reversed.

Individual pin receivers 72 are depicted as having an outer metal-comprising housing 76 and an inner metal-comprising sleeve 78 received within outer housing 76. Inner sleeve 78 comprises an opening 80 therein which is sized to slidably receive a single locking pin 74. Metal of inner sleeve 78 is preferably softer than that of housing 76. A reduction-to-practice example had outer metal-comprising housing 76 made of A36 steel, inner sleeve 78 made of oxygen-free, high-conductivity copper, and metal pin 74 (2.75 inch outer diameter) made of Maraging C-350 steel that was heat treated to a hardness of Rc 59.

By way of example only, a reason for employing such a pin-and-housing structure might be to enable utilizing fewer metal locking pins while allowing sufficient strength during a loading event without breaking and allowing entry. For example, the pin, inner, and outer sleeve sizes and materials of construction might be designed to allow significant motion of metal pins 74 relative to outer housing 72 without breaking and allowing entry, essentially by appreciable deformation of inner sleeve material 78.

It is anticipated that pins 74 would likely be electrically or pneumatically actuated. It might be desirable to provide a manual manner of moving such pins in the event of a power failure to enable approved ingress and egress relative to a structure/building 10. In one preferred implementation and as depicted, armor structure door 16 comprises a channel 80 within which a device might be employed to enable mechanically moving of pins 74 laterally outward to enable armor door 16 to be opened and closed in the absence of electrical power. For example, a suitable mechanism (not shown) might be provided within channel 80 for moving pins 74 laterally outward, and for example by a mechanical wheel (not shown) on the interior of armor door 16 (i.e., farthest away from attack side 15). Channel 80, by way of example only, is shown as being formed within a portion of armor structure 16 behind i-beam pairs 43 and layers 46 and 48. A layer or row 82 of hollow tubes 84 (i.e., 1 inch by 1 inch square A36 steel) is provided behind layer 48, followed by a layer 86 also preferably of A36 steel. Another layer 88 (i.e., A36 steel) combines with layer 86 to define exemplary channel 80. Exemplary thicknesses for layers 86 and 88 are 2 inches each. Such are depicted as retained relative to other portions of armor structure 16 with suitable doweled joints 90. One or more other portions of certain layers of preferred embodiment armor structure 16 might also secure relative to frame 17. For example, layer/plate 62 is shown securing to frame 17 via a suitable doweled joint 94.

In a reduction-to-practice example, cavity 80 was provided with a series of stiffening or support plates 96. Such comprised ½" thick A36 plates spaced 6" apart. A slot 98 was provided in plates 96 for a shaft of a mechanism (not shown) which can be used to manually actuate the locking pins, as referred to above.

The exemplary preferred embodiment armor door 16 could be constructed by initially providing a desired steel frame 17 open from the back, or open from the top. The various layers could then be slid into place within the internal volume of frame 17, with front and back plates ultimately welded thereto.

The following is provided as exemplary reasons why a preferred embodiment armor structure encompassing the various layers might be utilized. However, such reasons do not constitute a part of the invention unless appearing in a claim under analysis.

The depicted exemplary, multi-shaped, multi-material, setup for an armor door might provide multiple internal surface angles which serve to break up and disperse incoming shocks (i.e., from a blast), penetrating materials (i.e., from explosively-shaped charges), and gas or other jets (i.e., from a plasma torch). Further, multiple materials (i.e., mild A36 steel, significantly harder steel, aluminum, and polycarbonate) tend to break up shocks by creating reflecting boundaries at interfaces of dissimilar materials. Multiple materials also defeat traditional breaching methods, such as by grinding or torch cutting. Further, utilization of multiple layers of differing cross-sectional shapes and materials enables simultaneously protecting against a variety of possible threats such as blast, flyer plate, cutting torch, and abrasive cutting tools.

The particular preferred embodiment construction might be considered as resembling a graded, crushable foam, with small cross-section shapes near the attack face (soft), higher cross-section elements farther back (firm), followed by high cross-section/low flow stress aluminum (stiff), and finally, strong structural plates at the back to resist momentum imparted to the forward elements. Preferably, the selection of shapes provides a) increasing density and stiffness from the attack side to the protected side, b) many material interfaces at varying angles to mitigate incoming shocks, and c) interleaving of different materials to defeat specific attacks, e.g. polycarbonate to defeat thermal cutting tools, and hard steels to defeat abrasive tools, etc.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An armor structure configured as a barrier, comprising:

first and second layers individually comprising a plurality of i-beams, individual i-beams comprising a pair of longitudinal flanges interconnected by a longitudinal crosspiece and defining opposing longitudinal channels between the pair of flanges, the flanges having laterally outermost faces, the plurality of i-beams within individual of the first and second layers running parallel relative to one another with the laterally outermost faces of the flanges of adjacent i-beams facing one another, one of the longitudinal channels in each of the first and second layers facing one of the longitudinal channels in the other of the first and second layers; and the i-beam channels of the first layer running parallel with the i-beam channels of the second layer, the flanges of the i-beams of the first and second layers overlapping with the crosspieces of the other of the first and second layers and portions of said flanges being received within the facing channels of the i-beams of the other of the first and second layers.

2. The armor structure of claim 1 wherein the laterally outermost faces of the flanges of adjacent i-beams within at least one of the first and second layers contact one another.

3. The armor structure of claim 2 wherein the laterally outermost faces of the flanges of adjacent i-beams within each of the first and second layers contact one another.

4. The armor structure of claim 1 wherein the portions of the flanges of the i-beams of the first and second layers received within the facing channel of the other of the first and second layers contact the crosspieces of the other of the first and second layers.

5. The armor structure of claim 1 wherein the laterally outermost faces of the flanges of adjacent i-beams within each of the first and second layers contact one another, and the portions of the flanges of the i-beams of the first and second layers received within the facing channel of the other of the first and second layers contact the crosspieces of the other of the first and second layers.

6. The armor structure of claim 1 comprising a crosspiece lateral midpoint between the flanges of individual i-beams, the overlapping of the flanges of the i-beams of the first and second layers being centered within 25% of said midpoint as a function of crosspiece width between the flanges of individual i-beams.

7. The armor structure of claim 6 wherein the overlapping is centered within 10% of said midpoint.

8. The armor structure of claim 7 wherein the overlapping is centered within 1% of said midpoint.

9. The armor structure of claim 8 wherein the overlapping is at said midpoint.

10. The armor structure of claim 1 wherein the i-beams within individual of the first and second layers are of the same cross sectional size and shape.

11. The armor structure of claim 1 wherein all the i-beams within the first and second layers are of the same cross sectional size and shape.

12. The armor structure of claim 1 wherein, the laterally outermost faces of the flanges of adjacent i-beams within each of the first and second layers contact one another, and the portions of the flanges of the i-beams of the first and second layers received within the facing channel of the other of the first and second layers contact the crosspieces of the other of the first and second layers;

the crosspieces comprise a lateral midpoint between the flanges of individual i-beams, the overlapping of the flanges of the i-beams of the first and second layers being centered within 10% of said midpoint as a function of width of the crosspiece between the flanges of individual i-beams; and the i-beams within the first and second layers are all of the same cross sectional size and shape.

13. The armor structure of claim 12 wherein the overlapping is centered within 1% of said midpoint.

14. The armor structure of claim 1 comprising first and second pairs of said first and second layers, the channels of the first pair being oriented at an angle to the channels of the second pair.

15. The armor structure of claim 14 wherein the angle is 90°+/−1°.

16. The armor structure of claim 14 comprising a metal layer received intermediate the first and second pairs.

17. The armor structure of claim 16 wherein the i-beams of the first and second pairs are made of metal, the metal layer being of greater hardness than hardness all metal of the i-beams of the first and second pairs.

18. The armor structure of claim 1 comprising a volcanic glass-comprising material received within at least one of the non-facing channels of the i-beams of the first and second layers.

19. The armor structure of claim 18 wherein the armor structure is configured to have a primary attack side, the volcanic glass-comprising material being received within the non-facing channel which faces the primary attack side of the first and second layer closest to the primary attack side.

20. The armor structure of claim 18 wherein the volcanic glass-comprising material comprises pumice.

21. The armor structure of claim 18 wherein the volcanic glass-comprising material comprises perlite.

22. The armor structure of claim 18 wherein the volcanic glass-comprising material comprises a polymer within which volcanic glass is received.

23. The armor structure of claim 18 wherein the volcanic glass-comprising material fills a majority of said non-facing channel.

24. The armor structure of claim 23 wherein the volcanic glass-comprising material fills at least 90% of said non-facing channel.

25. The armor structure of claim 1 wherein the armor structure is configured to have a primary attack side, an obscurant-generating layer received closer to the primary attack side than are the first and second layers, the obscurant-generating layer configured to generate an obscurant upon sufficient degree of heat to the armor structure.

26. The armor structure of claim 25 wherein the obscurant-generating layer comprises polycarbonate.

27. The armor structure of claim 1 comprising a layer comprising a plurality of elongated hollow tubes oriented parallel one another.

28. The armor structure of claim 27 wherein the hollow tubes comprise four planar exterior faces.

29. The armor structure of claim 27 wherein the hollow tubes comprise substantially right angle corners.

30. The armor structure of claim 29 wherein the hollow tubes are substantially square in cross-section.

31. The armor structure of claim 27 wherein the armor structure is configured to have a primary attack side, the first and second layers being received closer to the primary attack side than is the layer comprising the plurality of elongated hollow tubes.

32. The armor structure of claim 1 wherein the armor structure is configured as a securable door that can be opened and closed relative to a doorway.

33. The armor structure of claim 32 wherein the door and doorway are configured for securing with a plurality of metal locking pin and pin receiver pairs, individual of the pin receivers comprising an outer metal-comprising housing and an inner metal-comprising sleeve received within the outer housing, the inner sleeve comprising an opening therein sized to slidably receive one of the locking pins, the metal of the inner sleeve being softer than that of the housing.

34. The armor structure of claim 32 wherein the metal of the inner sleeve comprises copper and the metal of the outer housing comprises steel.

35. The armor structure of claim 32 wherein the door comprises the pin receivers.

36. An armor structure, comprising:

first and second layers individually comprising a plurality of i-beams, individual i-beams comprising a pair of longitudinal flanges interconnected by a longitudinal crosspiece and defining opposing longitudinal channels between the pair of flanges, the flanges having laterally outermost faces, the plurality of i-beams within individual of the first and second layers running parallel relative to one another with the laterally outermost faces of the flanges of adjacent i-beams facing and contacting one another, one of the longitudinal channels in each of the first and second layers facing one of the longitudinal channels in the other of the first and second layers;

the i-beam channels of the first layer running parallel with the i-beam channels of the second layer, the flanges of the i-beams of the first and second layers overlapping with the crosspieces of the other of the first and second layers and portions of said flanges being received within the facing channels of the i-beams of the other of the first and second layers and contacting the cross pieces of the other of the first and second layers;

the armor structure being configured to have a primary attack side, volcanic glass-comprising material being received in the non-facing channels of the i-beams of the first and second layers which faces the primary attack side of the first and second layer closest to the primary attack side; and a layer comprising a plurality of elongated hollow tubes oriented parallel one another, the first and second layers being received closer to the primary attack side than is the layer comprising the plurality of elongated hollow tubes.

37. The armor structure of claim 36 comprising first and second pairs of said first and second layers, the channels of the first pair being oriented at 90°+/−1° to the channels of the second pair.

38. The armor structure of claim 36 wherein the volcanic glass-comprising material comprises a polymer within which volcanic glass is received.

39. An armor structure, comprising:

first and second layers individually comprising a plurality of metal i-beams, individual i-beams comprising a pair of longitudinal flanges interconnected by a longitudinal crosspiece and defining opposing longitudinal channels between the pair of flanges, the flanges having laterally outermost faces, the plurality of i-beams within individual of the first and second layers running parallel relative to one another with the laterally outermost faces of the flanges of adjacent i-beams facing and contacting one another, one of the longitudinal channels in each of the first and second layers facing one of the longitudinal channels in the other of the first and second layers;

the i-beam channels of the first layer running parallel with the i-beam channels of the second layer, the flanges of the i-beams of the first and second layers overlapping with the crosspieces of the other of the first and second layers and portions of said flanges being received within the facing channels of the i-beams of the other of the first and second layers and contacting the cross pieces of the other of the first and second layers, a crosspiece lateral midpoint between the flanges of individual i-beams, the overlapping of the flanges of the i-beams of the first and second layers being centered within 10% of said midpoint as a function of crosspiece width between the flanges of individual i-beams;

the armor structure being configured to have a primary attack side, volcanic glass-comprising material being received in the non-facing channels of the i-beams of the first and second layers which faces the primary attack side of the first and second layer closest to the primary attack side;

an obscurant-generating layer received closer to the primary attack side than are the first and second layers, the obscurant-generating layer configured to generate an obscurant upon sufficient degree of heat to the armor structure;

a layer comprising a plurality of elongated hollow metal tubes oriented parallel one another, the first and second layers being received closer to the primary attack side than is the layer comprising the plurality of elongated hollow tubes; and at least two metal layers received farther from the primary attack side than is the layer comprising the plurality of elongated hollow metal tubes, one of the two metal comprising a metal that is softer than metal of each of the metal i-beams, the elongated hollow metal tubes, and another of the two metal layers.

40. The armor structure of claim 39 wherein the overlapping is centered within 1% of said midpoint.

41. The armor structure of claim 40 wherein the overlapping is at said midpoint.

42. The armor structure of claim 39 comprising first and second pairs of said first and second layers, the channels of the first pair being oriented at an angle of 90°+/−1° to the channels of the second pair.

43. The armor structure of claim 42 comprising an intermediate metal layer received intermediate the first and second pairs.

44. The armor structure of claim 43 wherein the intermediate metal layer is of greater hardness than hardness of the metal of the i-beams of the first and second pairs.

45. The armor structure of claim 39 wherein the volcanic glass-comprising material comprises a polymer within which volcanic glass is received.

46. The armor structure of claim 39 wherein the volcanic glass-comprising material fills a majority of said non-facing channel.

47. The armor structure of claim 46 wherein the volcanic glass-comprising material fills at least 90% of said non-facing channel.

* * * * *